United States Patent [19]

Hirose et al.

[11] 4,005,770

[45] Feb. 1, 1977

[54] PRINTER

[75] Inventors: Mitsuo Hirose; Takashi Oono, both of Tokyo; Makoto Ueno, Kodaira, all of Japan

[73] Assignee: Citizen Watch Co., Ltd., Tokyo, Japan

[22] Filed: Oct. 20, 1975

[21] Appl. No.: 624,781

Related U.S. Application Data

[63] Continuation of Ser. No. 442,222, Feb. 13, 1974, abandoned.

[30] Foreign Application Priority Data

| | | |
|---|---|---|
| Feb. 19, 1973 | Japan | 48-19876 |
| Feb. 19, 1973 | Japan | 48-21303[U] |
| May 17, 1973 | Japan | 48-58095[U] |
| May 17, 1973 | Japan | 48-58096[U] |

[52] U.S. Cl. ..... 197/1 R; 101/93.05

[51] Int. Cl.[2] ..... B41J 3/10

[58] Field of Search ..... 197/1 R; 101/93.05

[56] References Cited

UNITED STATES PATENTS

| | | | |
|---|---|---|---|
| 3,217,640 | 11/1965 | Bradshaw | 197/1 R |
| 3,787,791 | 1/1974 | Borger et al. | 197/1 R X |
| 3,797,629 | 3/1974 | Moser | 197/1 R |
| 3,802,543 | 4/1974 | Howard | 197/1 R |
| 3,837,460 | 9/1974 | Chida et al. | 197/1 R |

FOREIGN PATENTS OR APPLICATIONS

| | | | |
|---|---|---|---|
| 1,531,666 | 5/1967 | France | 197/1 R |

*Primary Examiner*—Ralph T. Rader

*Attorney, Agent, or Firm*—Ernest G. Montague; Karl F. Ross; Herbert Dubno

[57] ABSTRACT

A printer is disclosed which comprises a type platen and a type head opposite the periphery of said type platen and spaced apart therefrom to form a given gap spacing therewith. The type head is located in a plane extending perpendicular to the axis of the type platen and is movable in a direction parallel to the axis of the platen. The typehead includes a plurality of impacting wires arranged radially about the axis of said type platen, a plurality of operating pins each secured to the rear end of each of the impacting wires, and a plurality of solenoids having corresponding armatures whose free ends are adapted to be engaged with the operating pins when the solenoids are energized in response to given print signals, the front ends of the impacting wires are caused to impact upon the peripheral surface of said type platen to imprint characters corresponding to these signals on a record sheet.

1 Claim, 12 Drawing Figures

PRINTER

This is a continuation of application Ser. No. 442,222, filed Feb. 13, 1974 now abandoned.

BACKGROUND OF THE INVENTION

1. Field of the Invention

This invention relates to printers responsive to given signals indicative of characters to be printed and capable of imprinting characters corresponding to these signals upon a record sheet. More particularly, the invention relates to a printer which can reciprocate a plurality of impacting wires arranged in a row on a type head in response to given signals indicative of characters to be printed and movable in a direction parallel to the axis of a type platen and which can reproduce the characters by an assembly of dots.

2. Description of the Prior Art

In the printers of the type described above, that region of a record sheet which is to be printed is extremely small, while a relatively large space must be provided for the mechanism for driving the plurality of impacting wires. It has, heretofore, been the common practice to bend the impacting wires such that adjacent impacting wires are gradually separated from each other from the front end of a type head toward the rear end thereof. Guides are provided to limit the direction of movement of the impacting wires to their axial directions. These guides subject the impacting wires to lateral pressure and, as a result, the response speed of the impacting wires responsive to given signals indicative of characters to be printed is low and the operation of the printer is unstable. In addition, the guides must be durable and are expensive.

The impacting wires are provided at their rear ends with operating pins engageable with armatures of solenoids. The conventional printer has the disadvantage that adjustment of and the like formed between respective solenoids and corresponding armatures is hindered by the presence of the members mounted on the printhead plate, whereby the operation becomes considerably troublesome.

SUMMARY OF THE INVENTION

An object of the invention is to provide a printer which makes use of rectilinear impacting wires and which can dispense with durable and expensive guides and which has a higher response speed with stable operation.

Another object of the invention is to provide a printer which is provided with a plurality of impacting wires converging toward the axis of a type platen which can easily reproduce alphanumeric patterns on a record sheet and which is simple in construction.

A further object of the invention is to provide a printer which can mitigate shocks produced when operating pins secured to the rear ends of the impacting wires are brought into engagement with stop and which can further improve the response speed with stable operation.

These objects of the invention are attained with a printer provided with a plurality of wire blocks each composed of a base plate on which are mounted an impacting wire, operating pin, armature, solenoid and a return spring, and which is in turn detachably mounted on a print head plate, thereby making handling and replacement of the assembly easy.

We also provide a printer rectilinear pipe-shaped intermediate bearings and rectilinear supporting members for impacting wires which facilitate the operation of these members and which can effectively prevent each of the impacting wires from being bent.

DETAILED DESCRIPTION OF THE INVENTION

Figure 1:
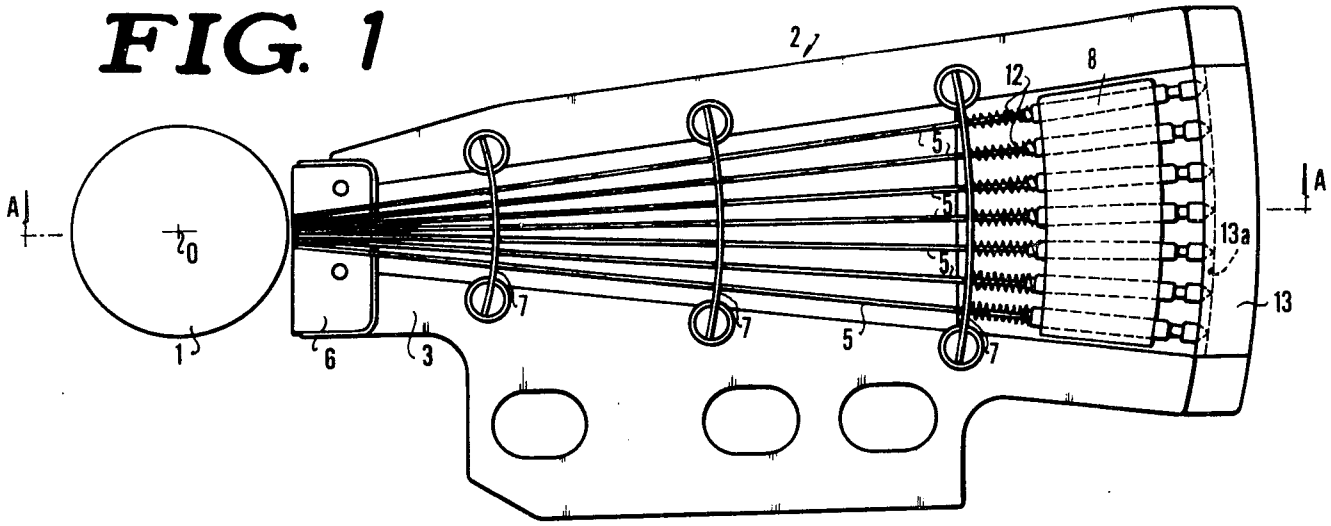
FIG. 1 is a side view showing the main parts of one embodiment of a printer according to the invention.
Figure 2:
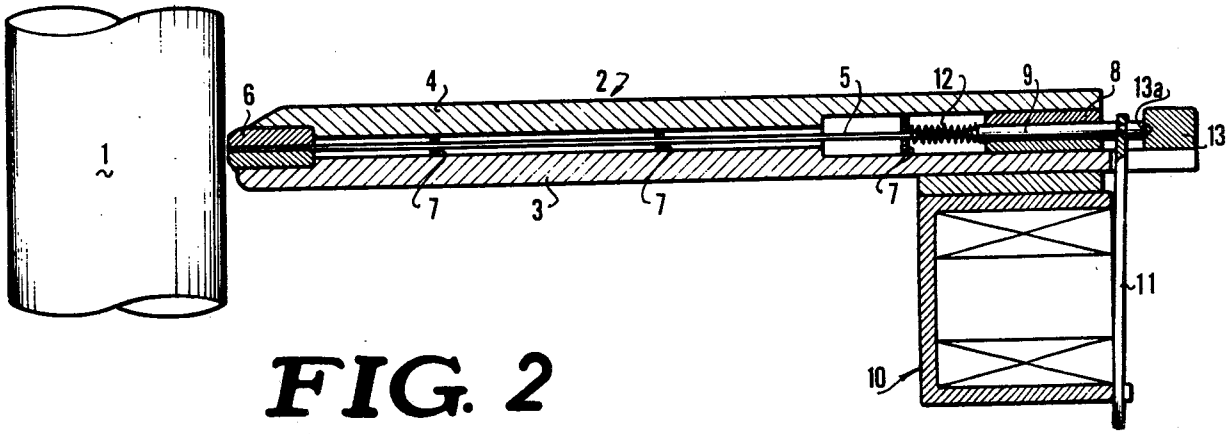
FIG. 2 is a sectional view taken along line A—A of FIG. 1.

The embodiments of the invention will now be described in greater detail with reference to the accompanying drawing. Referring to FIGS. 1 and 2, reference numeral 1 designates a type platen composed of a cylinder having a given diameter. Justaposed with the periphery of the type platen 1 is a type head 2 movable along a direction parallel to the axis 0 of the print platen 1 in response to given print signals. Between the print platen 1 and the print head 2 is formed a gap through which is passed a record sheet and an inked ribbon.

The type head 2 is composed of a pair of head plates 3 and 4 justaposed with but separated from each other to form a space therebetween and a plurality of impacting wires 5 axially shiftable in the space. In the present embodiment, use is made of seven impacting wires. Each of these impacting wires 5 is supported by means of a front end bearing 6 and a plurality of intermediate bearings 7 such that the axes of these impacting wires 5 extend radially from the axis 0 of the print platen 1 impacting wires 5 are separated one from the other and are axially movable. Each impacting wire 5 is provided at its rear end with an operating pin 9 secured thereto and supported by an end bearing 8.

To the head plate 3 are secured a plurality of solenoids 10 in number equal to the operating pins 9. On each solenoid 10 is pivotally mounted one end of an armature 11 the free end of which engages with the rear end of the operating pin 9. Each solenoid 10 is energized by a given signal supplied to it in response to a given pattern of a selected character type to attract the armature 11. As a result, the operating pin 9 and the impacting wire 5 secured thereto are forwardly shifted to cause a dot imprint by the front end of the impacting wire 5 upon a record sheet through an inked ribbon.

If the solenoid 10 is deenergized, the impacting wire 5 and the operating pin 9 are brought back into a position at which the rear end of the operating pin 9 is urged against a stop 13 by the action of spring 12 inserted between the intermediate bearing 7 located at the rear end and the operating pin 9.

It is preferable to secure the solenoids 10 in odd numbers to one of the head plates 3 and the solenoids in even numbers to the other head plate 4, respectively, so as to make the space between adjacent solenoids 10, 10 small, thereby improving the space factor of the printer.

Figure 3A:
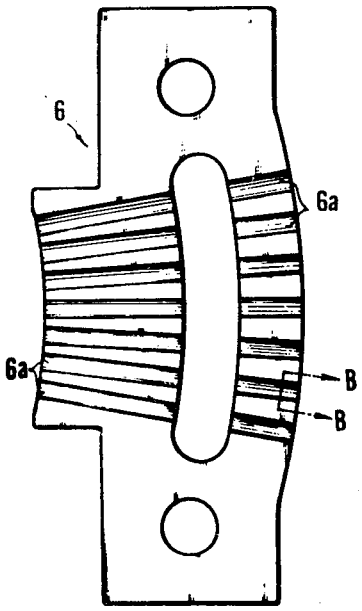
FIG. 3A is a side view of one embodiment of a front end bearing suitable for the printer shown in FIG. 1.
Figure 3B:
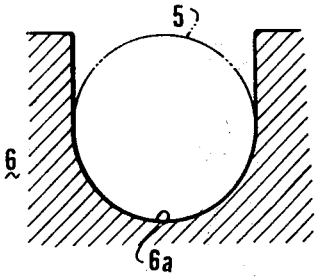
FIG. 3B is an enlarged sectional view taken along line B—B of FIG. 3A.

In FIGS. 3A and 3B is shown one embodiment of the front end bearing 6 composed of a plate member made of a material having a sufficiently high hardness and provided with a groove 6*a* for enclosing each impacting wire 5 therein and a flat cover plate (not shown) for closing the upper opening of the groove 6a.

Figure 3C:
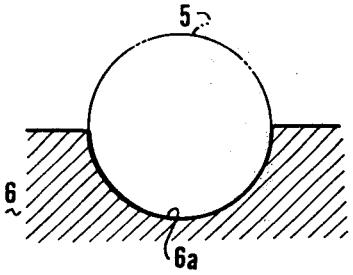
FIG. 3C is a sectional view similar to FIG. 3B but showing an alternative version of the front end bearing.

FIG. 3C shows another embodiment of the front end bearing 6 composed of a pair of plate members each having a hemisphere shaped groove 6*a* and superimposed one upon the other to form a circular channel therebetween through which extends each impacting wire 5.

Figure 4A:
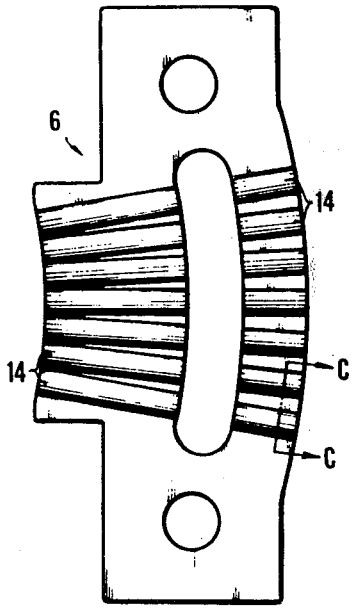
FIG. 4A is a side view similar to FIG. 3A but showing another alternative version of the front end bearing.
Figure 4B:
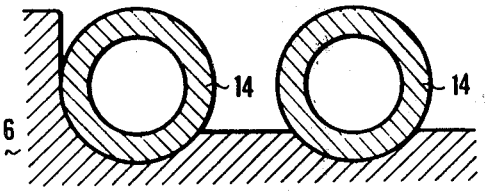
FIG. 4B is a sectional view taken along line C—C of FIG. 4A.

FIGS. 4A and 4B illustrate another preferred embodiment of the front end bearing 6 which is composed of a plurality of sleeves 14 each made of a material having a high hardness such as for example, ruby and secured to the head plate 3. Each impacting wire 5 is extended through the center bore of each sleeve 14.

The rear end of each operating pin 9 is made conical in shape with an apex angle of about 90° and is brought into engagement with the stop 13 arranged along an arcuate path extending circumferentially about the axis 0 of the pring platen 1. The stop 13 is provided with a plurality of notches 13*a* each having a V-shaped section, the included angle of the V-shaped notch being made substantially equal to the apex angle of the conical rear end of the operating pin 9.

In the type head constructed as above-described, if the solenoid 10 is energized, the armature 11 is attracted by the solenoid 10 and causes the operating pin 9 to move forwardly. If the solenoid 10 is deenergized, the spring 12 is released to urge the operating pin 9 against the stop 13 and the conical rear end of the operating pin 9 comes into engagement with the V-shaped notch 13*a* of the stop 13. The use of measures described ensures a significant absorption of shocks produced when the rear end of the operating pin 9 is struck against the stop 13 to effectively prevent rebounding. As a result, the operating pin 9 immediately after being urged against the stop 13 is stopped at a given position, thereby improving and stabilizing the response speed of the operating pin 9.

Figure 5:
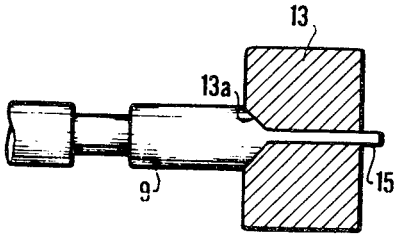
FIG. 5 is a longitudinal sectional view showing another embodiment of the operating pin and stop shown in FIG. 1.

As shown in FIG. 5, the operating pin 9 may be provided at its conical rear end with a projection 15 extended through a bore formed in the stop 13 and communicated at its front end with the bottom of the V-shaped notch 13*a*. The use of this measure is capable of maintaining the rear end of the operating pin 9 at a constant position when it is urged against the V-shaped notch 13*a* of the stop 13. In addition, the notch 13*a* may be made conical so as to be engaged with the conical rear end of the operating pin 9 at a conical surface.

Figure 6:
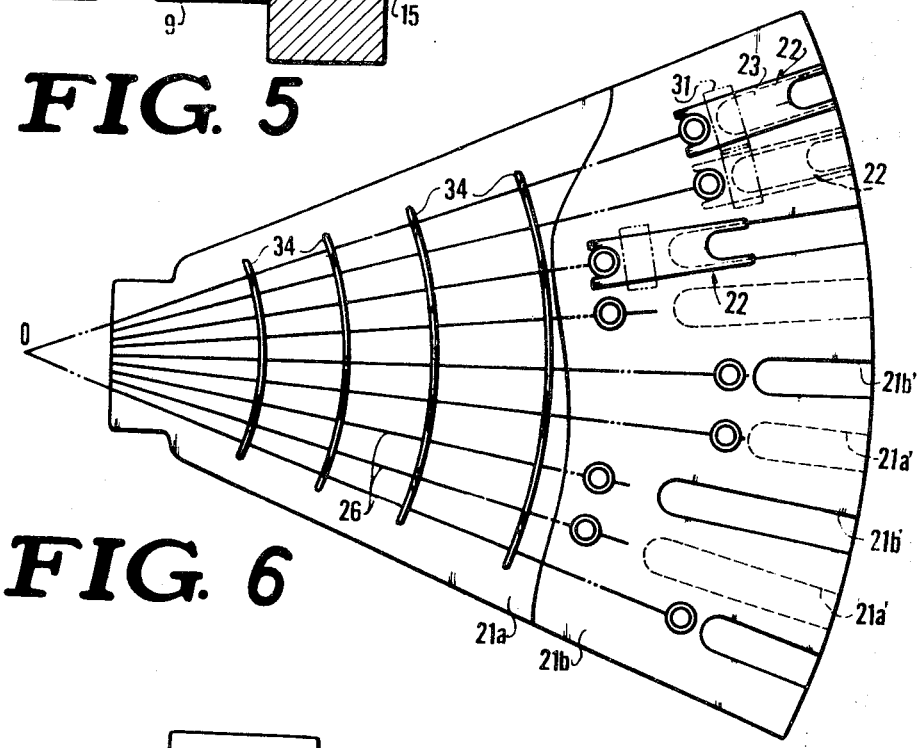
FIG. 6 is a side view showing another embodiment of the type head according to the invention, partly broken away.

In FIG. 6 is shown another embodiment of the type head composed of a pair of substantially sector shaped head plates 21*a* and 21*b*. These head plates 21*a* and 21*b* are opposed and separated from each other to form a space therebetween and secured together by means of bolts (not shown). On respective head plates 21*a* and 21*b* are detachably mounted a plurality of wire blocks 22, respectively.

Figure 7:
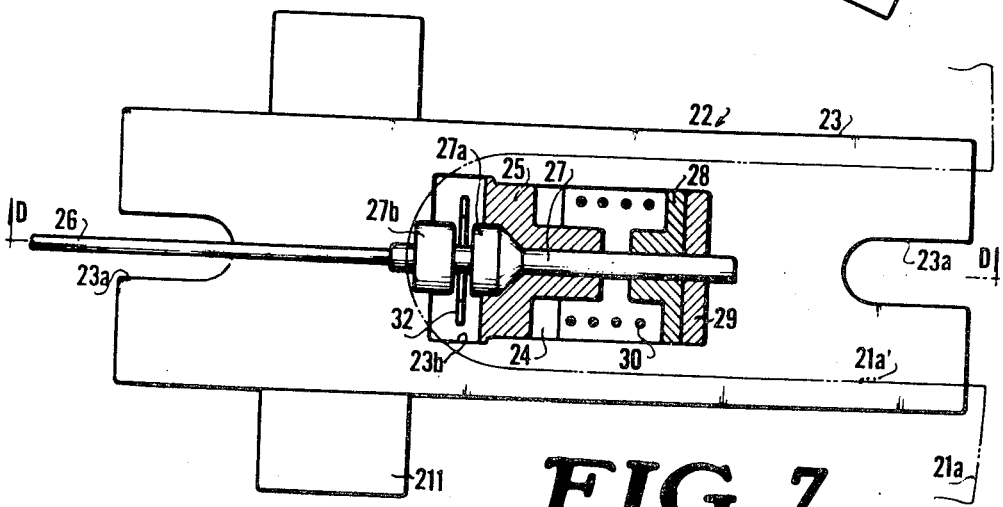
FIG. 7 is a side view showing one of the wire blocks of FIG. 6 in enlarged scale.
Figure 8:
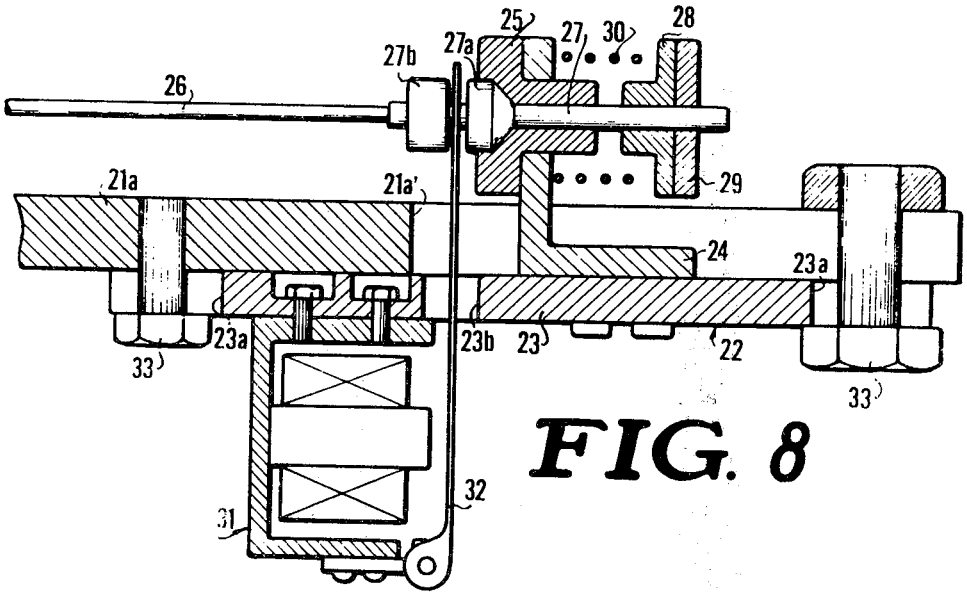
FIG. 8 is a sectional view taken along line D—D of FIG. 7.

In FIGS. 7 and 8 is shown one of the wire blocks 22. The wire block 22 is composed of a base plate 23 which is substantially rectangular in shape and provided at its ends with notches 23*a* each extending in a lengthwise direction. To the base plate 23 is secured a bracket 24 which supports a bearing 25. The bearing 25 slidably supports an operating pin 27 secured to the rear end of an impacting wire 26. The front end 27*a* of the operating pin 27 is made conical in shape and serves as a stop for limiting the axial movement of the operating pin 27. A spring 30 is inserted between the bearing 25 and two nuts 28, 29 threadedly engaged with the rear end of the operating pin 27 and urges the conical front end 27*a* of the operating pin 27 against the bearing 25.

To the base plate 23 is secured a solenoid 31 by which is pivotally supported one end of an armature 32 whose free end is inserted between the conical front end 27*a* of the operating pin 27 and a disc 27*b* secured to the rear end of the impacting wire 26. The base plate 23 is provided with a hole 23*b* through which the armature 32 extends.

If the solenoid 31 is energized in response to a given print signal, the armature 32 is rotated about its pivot in a counterclockwise direction to forwardly shift the operating pin 27 and the impacting wire 26.

If the solenoid 31 is deenergized, the spring 30 causes the impacting wire 26, operating pin 27 and armature 32 to return to their respective original positions.

The head plates 21*a* and 21*b* are provided at their arcuate ends with a plurality of grooves 21*a'* and 21*b'* extending lengthwise direction, respectively, as shown by two dots and dash lines in FIG. 7. The adjacent grooves 21*a'*, 21*b'* formed in the head plates 21*a* and 21*b* are preferably different in length. The groove 21*b'* of the head plate 21*b* is located intermediate between the adjacent grooves 21*a'* and 21*c'* of the head plate 21*a*.

In assembling the wire block 22 within the head plates 21*a*, 21*b*, the bracket 24 and armature 32 are extended through the grooves 21*a'*, 21*b'*. Then, the base plate 23 is secured to the head plate 21*a* or 21*b* by means of two bolts 33.

The impacting wires 26 are held between the base plates 21*a* and 21*b* by means of a plurality of intermediate bearings 34 such that respective axes of the impacting wires 26 pass through the axis 0 of the type platen 1.

The type head constructed as above described is capable of permitting adjusting of respective wire blocks 22 separately to given standard positions and assembling these wire blocks 22 with the head plates 21*a* and 21*b* in a given relation, thereby providing a type head having the desired characteristics. In addition, the use of two head plates 21*a* and 21*b* provides the important advantage that each wire block 22 can be enclosed in a space having a small volume, and that the type head can be made small.

Figure 9:
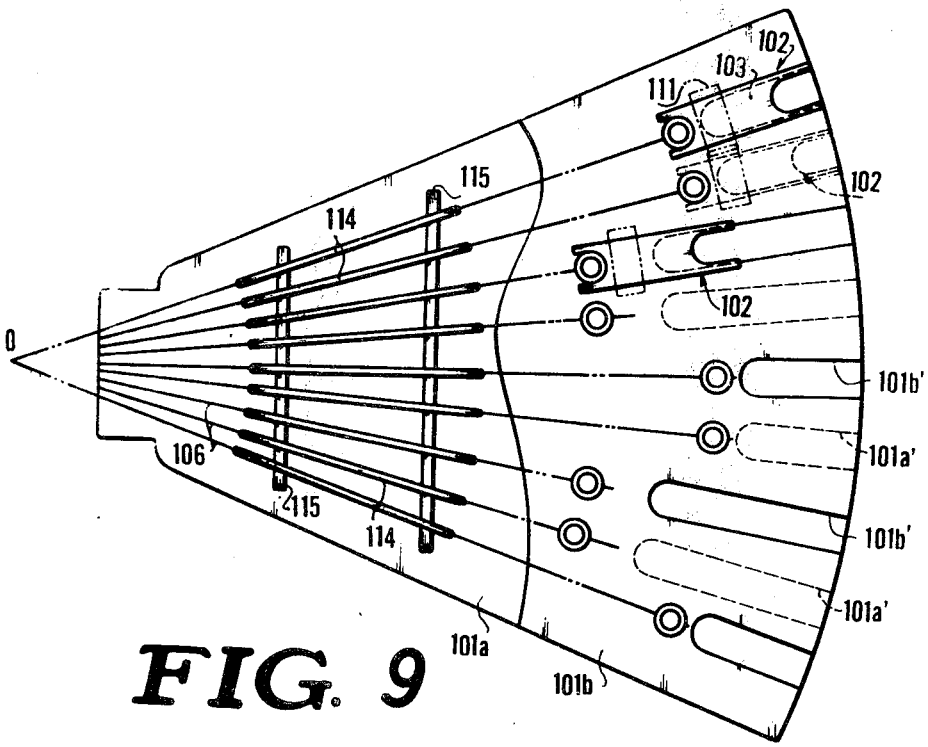
FIG. 9 is side view similar to FIG. 6 but showing an alternative version of the print head, partly broken away.

FIG. 9 shows a modified type head which comprises a plurality of intermediate bearings 114 in a fan array each composed of a pipe whose inner diameter is slightly larger than the diameter of the impacting wire 106. These intermediate bearings 114 are secured, for example, by soldering to supporting members 115 arranged transversely to the intermediate bearings 114.

The use of the pipe shaped intermediate bearings 114 permits of providing rectilinear supporting members 115 instead of arcuate supporting members each provided with a hole through which extends an impacting wire 106, whereby the supporting members 115 can be produced in a simple manner. In addition, the pipe shaped intermediate bearings 114 can effectively prevent each impacting wire 106 from becoming bent, and as a result, it is possible to operate the impacting wire 106 in a reliable manner for a long time.

What is claimed is:

1. A dot printer having a platen and a type head and wherein:

a. said type head is flat and arranged perpendicularly to a row of character-printing positions; and b. said type head is shiftable along said platen in a direction parallel to said row to print dots in a pattern on a record layer interposed between said platen and said type head, said type head comprising:

1. a pair of head plates lying generally in a plane perpendicular to said platen and transversely of said row, 2. a fan array of rectilinear impacting wires extending between and axially slidable through said head plates, said array lying in said plane perpendicular to said platen and said row, said array converging toward said platen, 3. operating pins each having one end respectively secured on each of said wires at ends thereof remote from said platen, said operating pins having free ends remote from said wires, said pins lying in a fan array, 4. solenoids mounted on said plates in a fan array corresponding to that of said pins and having respective armatures with free ends engaging the free ends of said pins for displacing same and the wires rectilinearly upon energization of the respective solenoids, 5. stop means on said plates for engagement with said wires, 6. said head plates being provided at ends immediately proximal to said platen with front bearings formed with recesses for slidably supporting said wires at their ends proximal to said platen, 7. a plurality of support members extending across said array and a plurality of tubular intermediate members mounted on said support members and slidably traversed by the respective wires.

8. a plurality of wire blocks each associated with a respective one of said wires, each of said wire blocks having a base plate, 9. a bracket mounted on said base plate and a bearing carried by said bracket and slidably receiving a respective pin of a respective wire, each solenoid being secured to the respective base, said blocks being detachably mounted on said head plates, said solenoids being staggered in a zigzag arrangement on said head plates, and respective fingers pivotally mounted at one end on the respective base plate and extending with clearance through the respective head plate to engage a respective pin, each of said fingers being attractable by one of said solenoids and forming said armatures.

* * * * *